US005226390A

United States Patent [19]

Nakagawa

[11] Patent Number: 5,226,390

[45] Date of Patent: Jul. 13, 1993

[54] APPARATUS FOR CONTROLLING VARIATION IN TORQUE OF INTERNAL COMBUSTION ENGINE

[75] Inventor: Norihisa Nakagawa, Numazu, Japan

[73] Assignee: Toyota Jidosha Kabushiki Kaisha, Toyota, Japan

[21] Appl. No.: 805,064

[22] Filed: Dec. 11, 1991

[30] Foreign Application Priority Data

Dec. 14, 1990 [JP] Japan ..... 2-402463

[51] Int. Cl.[5] ..... F02D 41/04; F02M 25/07

[52] U.S. Cl. ..... 123/436; 123/571

[58] Field of Search ..... 123/419, 436, 571; 364/431.08

[56] References Cited

U.S. PATENT DOCUMENTS

| | | | |
|---|---|---|---|
| 4,513,721 | 4/1985 | Ina et al. | 123/436 X |
| 4,543,934 | 10/1985 | Morita et al. | 123/436 X |
| 4,617,892 | 10/1986 | Staerzl | 123/436 X |
| 4,724,813 | 2/1988 | Cinpinski | 123/436 |
| 4,977,508 | 12/1990 | Tanaka et al. | 123/436 X |
| 4,991,555 | 2/1991 | Tamekio | 123/436 |
| 5,060,618 | 10/1991 | Takaoka et al. | 123/436 |

FOREIGN PATENT DOCUMENTS

| | | |
|---|---|---|
| 0267444 | 3/1990 | Japan . |
| 0275742 | 3/1990 | Japan . |
| 0176132 | 7/1990 | Japan . |

*Primary Examiner*—Willis R. Wolfe

*Attorney, Agent, or Firm*—Kenyon & Kenyon

[57] ABSTRACT

An apparatus for controlling a torque generated by an internal combustion engine includes a measurement unit for measuring a torque variation amount of the internal combustion engine, and a detection unit for detecting a stable state where the torque variation amount is continuously maintained in an allowable torque variation range during a predetermined period. A control part controls a predetermined engine control parameter of the internal combustion engine so that the torque variation amount is maintained in the allowable torque variation range when the detection unit does not detect the stable state, and controls the predetermined engine control parameter so that the torque variation amount increases when the detection unit detects the stable state.

23 Claims, 12 Drawing Sheets

| Q / N / S / M | | | | | |
|---|---|---|---|---|---|
| | $K_{30}$ | $K_{31}$ | $K_{32}$ | $K_{33}$ | $K_{34}$ |
| | $K_{20}$ | $K_{21}$ | $K_{22}$ | $K_{23}$ | $K_{24}$ |
| | $K_{10}$ | $K_{11}$ | $K_{12}$ | $K_{13}$ | $K_{14}$ |
| | $K_{00}$ | $K_{01}$ | $K_{02}$ | $K_{03}$ | $K_{04}$ |

800 NE 3200 (rpm)

APPARATUS FOR CONTROLLING VARIATION IN TORQUE OF INTERNAL COMBUSTION ENGINE

BACKGROUND OF THE INVENTION

1. Field of the Invention

The present invention generally relates to an apparatus for controlling a variation in torque of an internal combustion engine, and more particularly to a torque variation control apparatus which controls a predetermined parameter of the internal combustion engine so that the amount of intercycle variation in torque of the internal combustion engine is maintained within an allowable torque variation amount range.

2. Description of the Related Art

As is well known, various apparatuses have been proposed which intend to improve the fuel economy of an internal combustion engine and reduce the amount of nitrogen oxides (NOx) therein. Japanese Laid-Open Patent Publication No. 2-67446, for example, discloses an apparatus which measures the amount of intercycle variation in torque of the internal combustion engine and controls a predetermined engine control parameter so that the measured intercycle torque variation amount becomes equal to a target torque variation amount. Some features of conventional methods are, for example, that the air-fuel ratio is controlled so that a mixture of air and fuel is as lean as possible, or that an exhaust gas recirculation system is controlled so that an increased amount of exhaust gas s fed back to an intake manifold.

More specifically, the apparatus disclosed in the above Japanese publication detects only a decrease in the torque for each cycle and accumulates decreases in the torque for a predetermined number of cycles. An accumulated amount is defined as the amount of torque variation (a torque variation amount). The torque variation amount is compared with a target torque variation amount (torque variation decision value), and a predetermined engine control parameter, such as the air-fuel ratio or the amount of recirculated exhaust gas, is controlled on the basis of the result of comparison.

In the above-mentioned torque variation control apparatus, there is a response delay until a controlled amount of fuel is actually injected into an intake system. There is also a response delay until a controlled amount of exhaust gas is actually supplied to the intake system. In order to prevent hunting arising from the above response delay, an allowable torque variation amount range including a target torque variation amount is defined. In actuality, the allowable torque variation range is determined, taking into account a dispersion in the torque variation amount.

FIG. 1 is a graph of a torque variation amount vs. air-fuel ratio (or the amount of recirculated exhaust gas) characteristic curve I. The torque variation amount in FIG. 1 is measured by means of a combustion pressure sensor. A line indicated by II is the target torque variation amount (torque variation decision value). The characteristic curve I has a sharp slope when the torque variation amount is greater than the torque variation decision value II because the combustion reaction is unstable. When the torque variation amount is small, the characteristic curve I has a gentle slope because the combustion reaction is stable. Hence, when the torque variation amount is large, it is easy to determine whether or not the torque variation amount is greater than the torque variation decision value II. However when the torque variation amount is smaller than the torque variation decision value II, particularly when the torque variation amount is close to a lower limit of an allowable torque variation range (dead range) III, it is very difficult to determine whether or not the torque variation amount is within the allowable torque variation range III because the characteristic curve I has a gentle slope.

When the detected torque variation amount is within the allowable torque variation range III, the control (combustion reaction) is in the stable state. If the detected torque variation amount corresponds to a point A in the stable state, the air-fuel ratio (or the amount of recirculated exhaust gas) is maintained stably at a level "a" because A is within the allowable torque variation range III. However, it is desired that originally the air-fuel ratio be controlled to a lean level "b" (or that the amount of recirculated exhaust gas be controlled to a rich level of exhaust gas "b"). Hence, an amount of fuel corresponding to the difference between "b" and "a" is wasted, and emissions degrade by an amount corresponding to the difference between "b" and "a".

SUMMARY OF THE INVENTION

It is a general object of the present invention to provide a torque variation control apparatus in which the above disadvantages are eliminated.

A more specific object of the present invention is to provide a torque variation control apparatus capable of controlling the internal combustion engine so that the torque variation amount is always regulated at a level equal to or close to the target torque variation amount even if the detected torque variation amount is small.

The above-mentioned objects of the present invention are achieved by an apparatus for controlling a torque generated by an internal combustion engine, the apparatus comprising: measurement means for measuring a torque variation amount of the internal combustion engine; detection means for detecting a stable state where the torque variation amount is continuously maintained in an allowable torque variation range during a predetermined period; and control means, coupled to the measurement means and detection means, for controlling a predetermined engine control parameter of the internal combustion engine so that the torque variation amount is maintained in the allowable torque variation range when the detection means does not detect the stable state and for controlling the predetermined engine control parameter so that the torque variation amount increases when the detection means detects the stable state.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
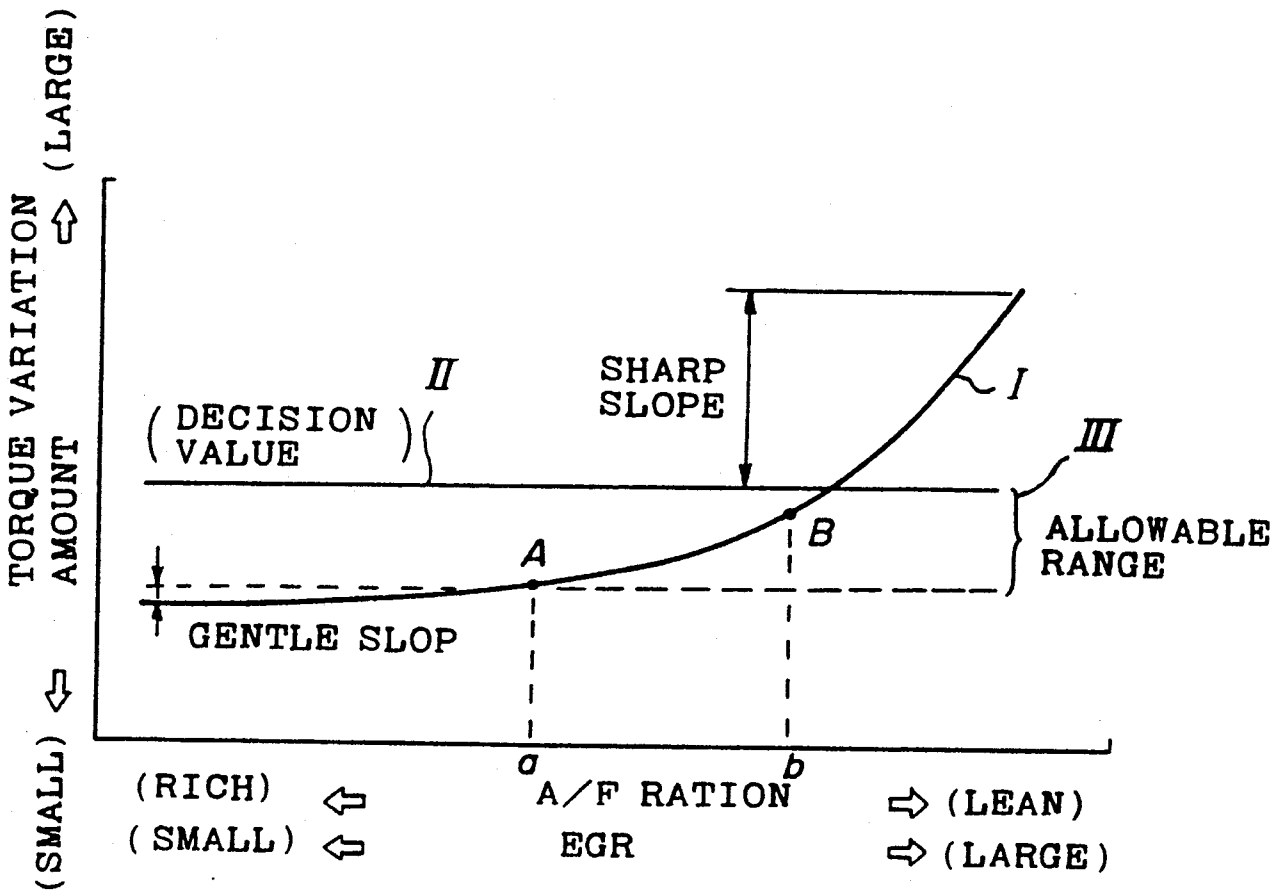
FIG. 1 is a graph showing the relationship between the torque variation amount and the air-fuel ratio (the amount of recirculated exhaust gas)
Figure 2A:
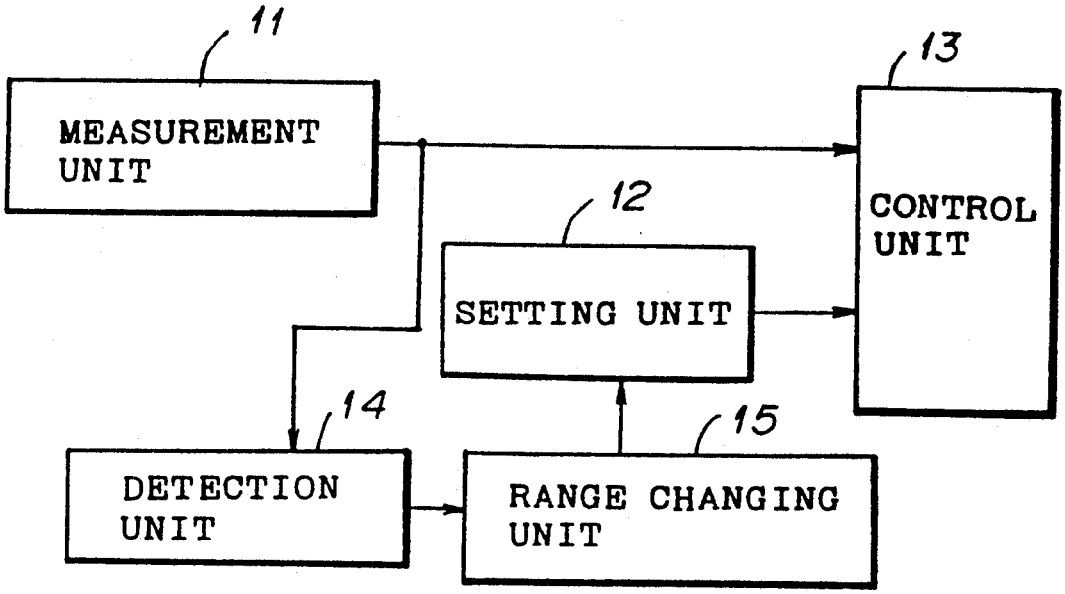
FIG. 2A is a block diagram of a torque variation control apparatus according to a first preferred embodiment of the present invention.

FIG. 2A is a block diagram of a torque variation control apparatus according to a first preferred embodiment of the present invention. The torque variation control apparatus shown in FIG. 2A is composed of a measurement unit 11, a setting unit 12, a control unit 13, a detection unit 14 and an allowable torque variation amount range changing unit (hereafter simply referred to as a range changing unit) 15.

The measurement unit 11 measures an intercycle variation amount of torque generated by an internal combustion engine. The intercycle variation amount of torque is the torque difference between consecutive cycles of the engine. The control unit 13 controls a predetermined engine control parameter so that the intercycle torque variation amount measured by the measurement unit 11 is always within an allowable torque variation amount range which is determined by the setting unit 12. The detection unit 14 detects a state in which the torque variation amount, measured for each of a predetermined number of consecutive periods, is within the allowable torque variation range. When the above state is detected, the range changing unit 15 changes the allowable torque variation range so that the lower limit thereof is changed upwardly, thus narrowing the range (toward an increasing torque variation amount). With this arrangement, it becomes possible to maintain the torque variation amount at the upper limit of the allowable torque variation range, which upper limit corresponds to a target torque variation amount.

Figure 3:
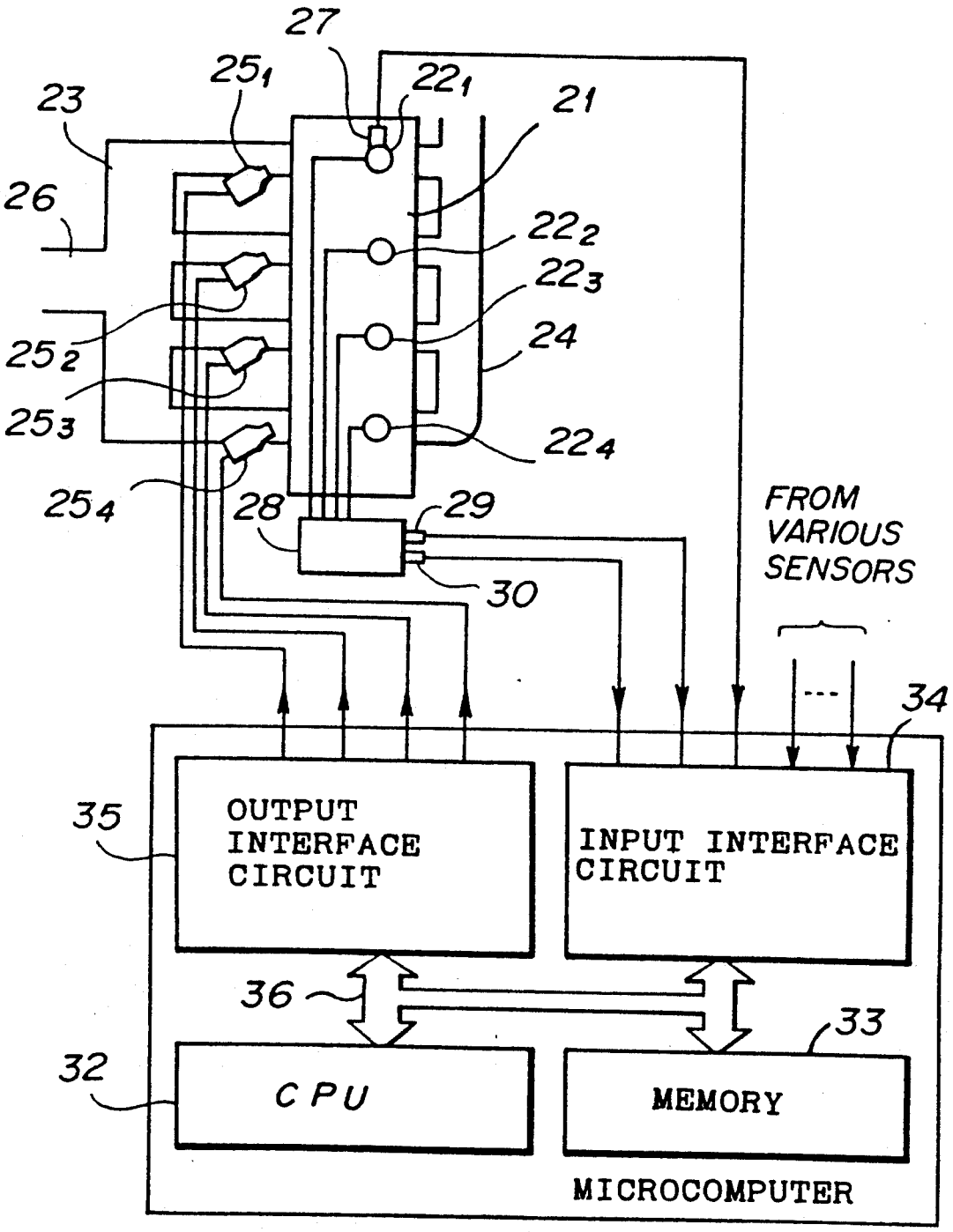
FIG. 3 is a block diagram of an outline of an internal combustion engine to which the present invention is applied.

FIG. 3 shows an outline of an internal combustion engine to which the present invention is applied. The internal combustion engine shown in FIG. 3 is a four-cylinder ignition type internal combustion engine, and has an engine main body 21 to which ignition plugs $22_1$, $22_2$, $22_3$ and $22_4$ are attached. Combustion chambers for the four respective cylinders are coupled to an intake manifold 23 having four branches, and an exhaust manifold 24 having four branches.

Fuel injection valves $25_1$, $25_2$, $25_3$ and $25_4$ are respectively provided on the downstream sides of the four branches of the intake manifold 23. The upstream side of the intake manifold 23 is coupled to an intake passage 26. A combustion pressure sensor 27, which is fastened to the first cylinder (#1), directly measures pressure inside the first cylinder. The combustion pressure sensor 27 is, for example, a heat-resistant piezoelectric type sensor, and generates an electric signal based on the pressure inside of the first cylinder.

A distributor 28 distributes a high voltage to the ignition plugs $22_1$–$22_4$. A reference position sensor 29 and a crank angle sensor 30 are fastened to the distributor 28. The reference position sensor 29 generates a reference position detection pulse signal every crank angle of 720°, and the crank angle sensor 29 generates a crank angle detection signal every crank angle of 30°.

A microcomputer 31 is composed of a CPU (Central Processing Unit) 32, a memory 33, an input interface circuit 34, and an output interface circuit 35, all of which are mutually coupled via a bidirectional bus 36. The microcomputer 31 realizes the units 11–15 shown in FIG. 2A.

Figure 4:
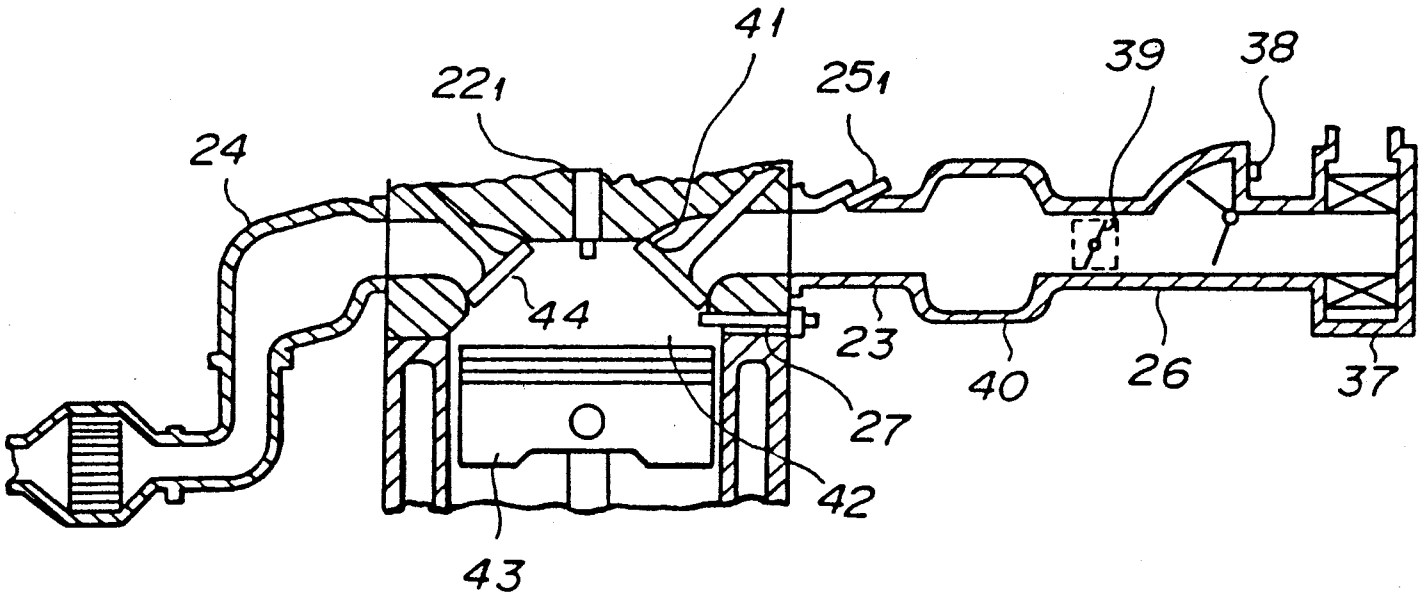
FIG. 4 is a cross-sectional view of a first cylinder of the internal combustion engine shown in FIG. 3 and a structure in the vicinity of the first cylinder.

FIG. 4 shows the first cylinder to which the combustion pressor sensor 27 is fastened, and shows a structure in the vicinity of the first cylinder. In FIG. 4, those parts which are the same as those shown in FIG. 3 are given the same reference numerals. An airflow meter 38 measures the amount of air, which has been filtered by an air cleaner 37. Then, the air passes through a throttle valve 39 provided in the intake passage 26, and is distributed to the branches of the intake manifold 23 by means of a surge tank 40. The air moving toward the first cylinder is mixed with fuel injected by the fuel injection valve $25_1$, and is sucked into a combustion chamber 42 when an intake value 41 is opened. A piston 43 is provided inside the combustion chamber 42, which is coupled to the exhaust manifold 24 via an exhaust valve 44. A leading end of the combustion pressure sensor 27 projects from the inner wall of the cylinder.

Figures 5A, 5B:
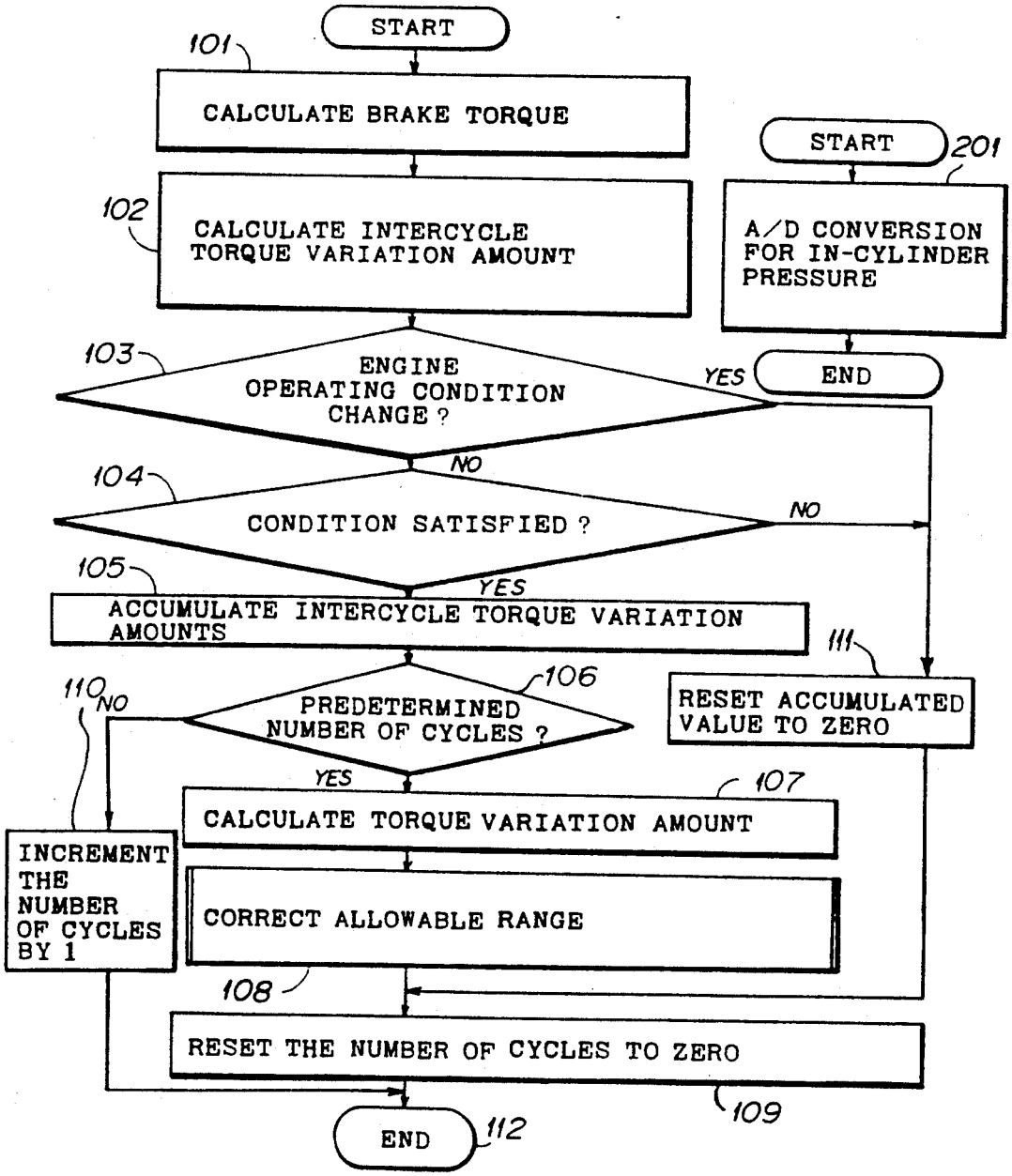
FIGS. 5A and 5B, respectively, are flowcharts of a torque variation control procedure according to the first preferred embodiment of the present invention.

A description will now be given, with reference to FIGS. 5A and 5B, of a torque variation control procedure executed by the microcomputer 31. FIG. 5A shows a main routine of the torque variation control procedure, and is activated every 720° of crank angle (CA). FIG. 5B is an in-cylinder pressure input routine, which is activated by an interruption occurring every 30° of crank angle (CA). At step 201 of the interruption routine shown in FIG. 5B, an analog electric signal (combustion pressure signal) input to the interface circuit 34 from the combustion pressure sensor 27 is converted into a digital signal, which is stored in the memory 33. That is, the digital signal is stored in the memory 33 when the crank angle indicated by the crank angle detection signal is equal to BTDC (Before Top Dead Center) 155°, ATDC (After Top Dead Center) 5°, ATDC 20°, ATDC 35° or ATDC 50°.

Figure 7:
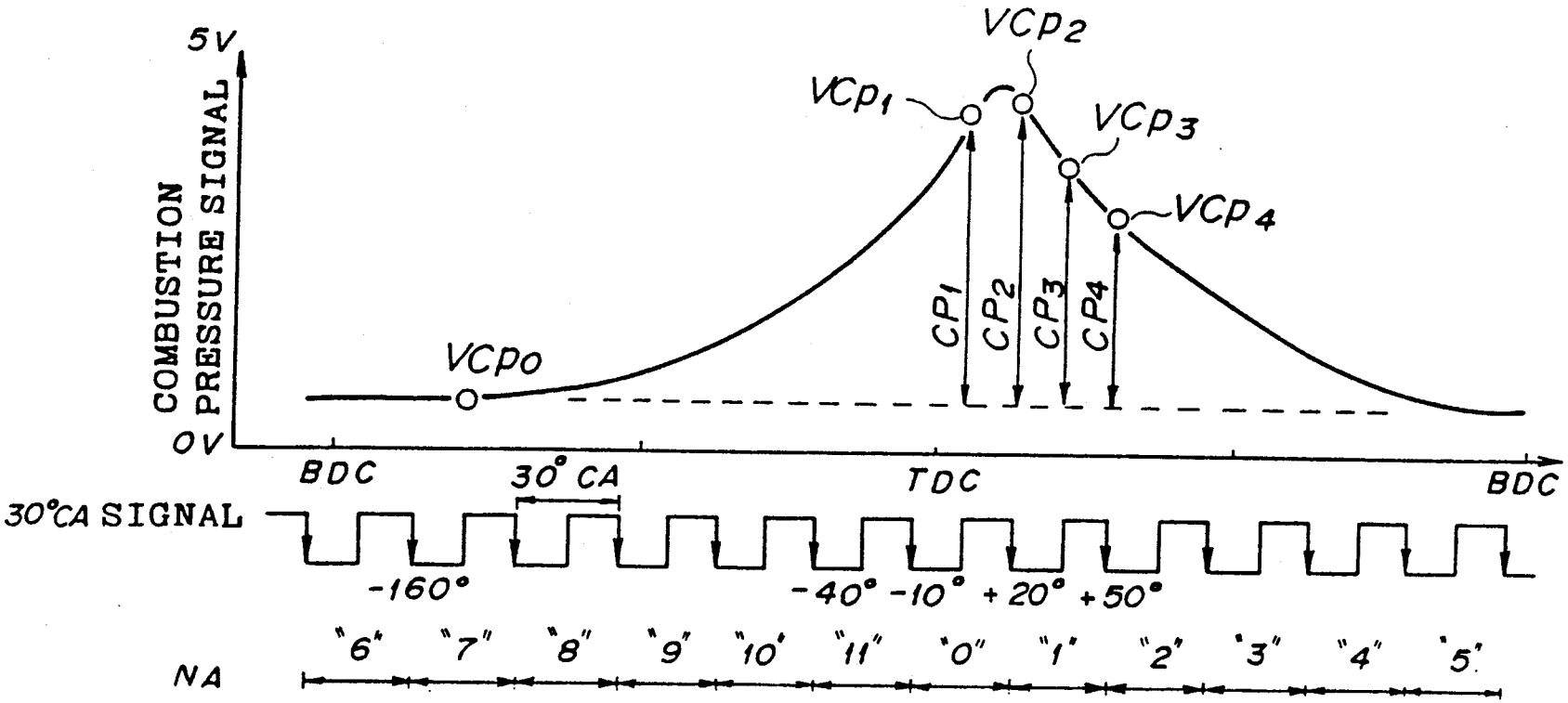
FIG. 7 is a diagram showing a relationship between a combustion pressure signal and a crank angle and a relationship between the combustion pressure signal and an engine revolution counter value in an angle counter.

FIG. 7 is a diagram showing the relationship between combustion pressure signal and crank angle (CA) and the relationship between the combustion pressure signal and the engine revolution counter value (engine revolution number) (NA). A combustion pressure signal VCP0 obtained with the crank angle equal to BTDC 155° is a reference level with respect to other crank angles in order to compensate for a drift of the combustion pressure signal due to a temperature change in the combustion pressure sensor 27 and a dispersion of the offset voltage.

In FIG. 7, VCP1, VCP2, VCP3 and VCP4, respectively, are combustion pressure signals obtained when the crank angle is equal to ATDC 5°, ATDC 20°, ATDC 35° and ATDC 50°. NA denotes the counter value of the angle counter, which increases by 1 each time a 30° crank angle interruption is generated and is cleared every 360° crank angle. Since the ATDC 5° and ATDC 35° do not coincide to the 30° crank angle interruption positions. A timer (formed by software) is provided in which a time corresponding to a crank angle of 15° is set at the 30° interruption positions (NA="0", "1") immediately prior to ATDC 5° and ATDC 35°. The interruption request is given to the CPU 32 by means of the above timer.

At step 101 shown in FIG. 5A which is first executed each time the main routine is activated every 720° of crank angle, the CPU 32 calculates the magnitude of a brake torque by using five pieces of combustion pressure data in the following manner. First, a combustion pressure CPn (n=1−4) with respect to VCP0 is calculated as follows:

$$CPn = K1 \times (VCPn - VCP0) \quad (1)$$

where K1 is a combustion-pressure-signal to combustion-pressure conversion coefficient. Next, the brake torque PTRQ for each of the cylinders is calculated as follows:

$$PTRQ = K2 \times (0.5CP1 + 2CP2 + 3CP3 + 4CP4) \quad (2)$$

where K2 is a combustion-pressure to torque conversion coefficient.

At step 102, the CPU 32 calculates intercycle torque variation amount DTRQ during a predetermined cycle for each of the cylinders as follows:

$$DTRQ = PTRQ_{i-1} - PTRQ_{i\,(DTRQ \geqq 0)} \quad (3)$$

where $PTRQ_{i-1}$ is the previous brake torque, and $PTRQ_i$ is the present brake torque. It is recognized that torque variation occurs only when the intercycle torque variation amount DTRQ has a positive value, in other words, when the torque decreases. This is because it can be recognized that the torque changes along an ideal torque curve when DTRQ has a negative value.

Figure 8:
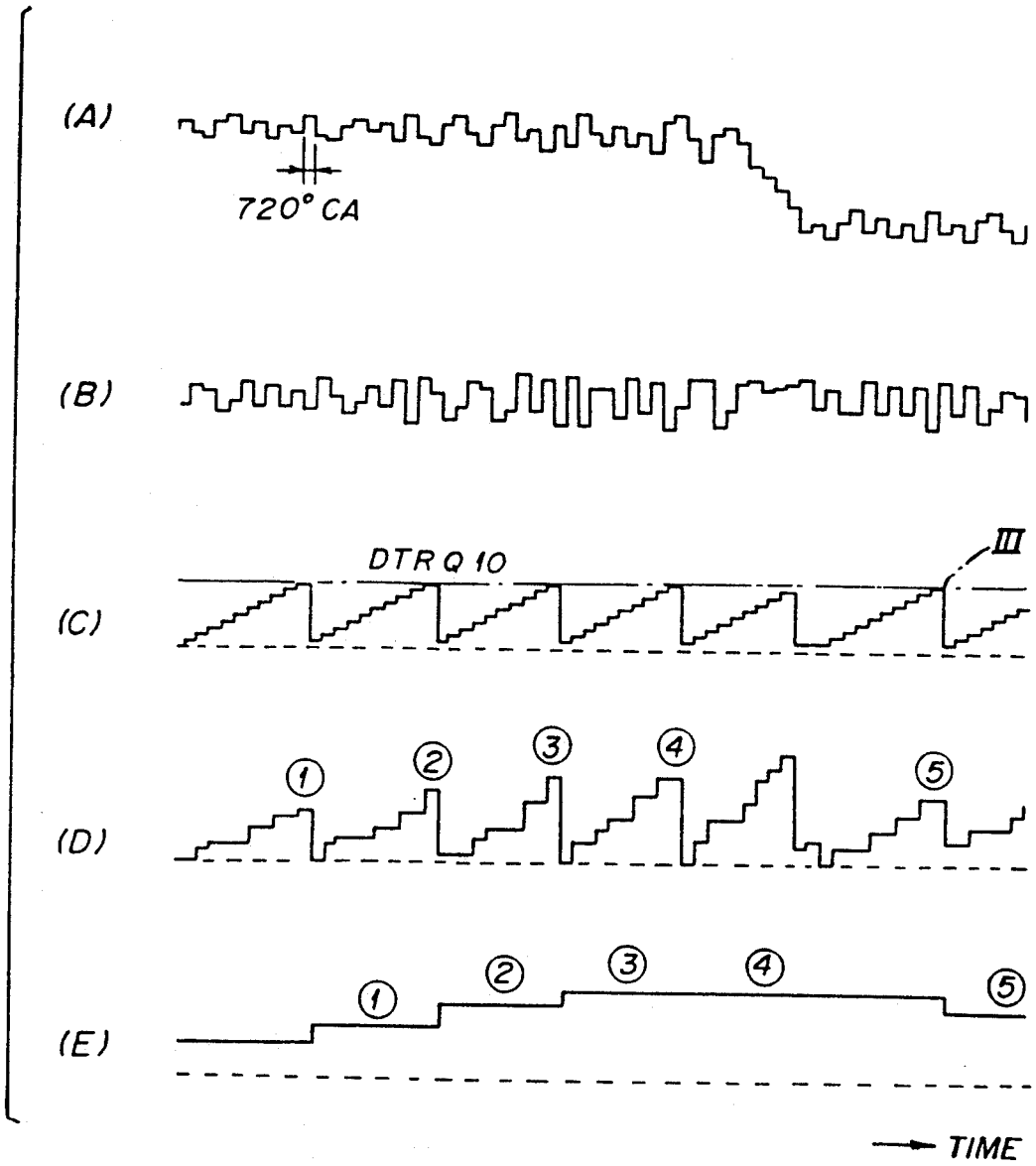
FIG. 8 is a waveform diagram showing a procedure for accumulating intercycle torque variation amounts.

If the brake torque PTRQ changes as shown in (A) of FIG. 8, the intercycle torque variation amount DTRQ changes a shown in (B) of FIG. 8.

At step 103, the CPU 32 determines whether or not a present engine operating area $NOAREA_i$ has changed from the previous engine operating area $NOAREA_{i-1}$. When the present engine operating area $NOAREA_i$ is the same as the previous operating area $NOAREA_{i-1}$, the CPU 32 executes step 104, at which step it is determined whether or not the engine is operating under a condition at which a torque variation determination procedure should be executed. A torque variation decision value (target torque variation amount) KTH is defined for each of the engine operating conditions, as will be described in detail later. The torque variation determination procedure is not carried out when the engine is in a decelerating state, an idle state, an engine starting state, a warm-up state, an EGR ON state, a fuel cutoff state, a state before a weighted average (torque variation amount) is calculated, or a non-learning state. When it is determined, at step 104, that the engine is not in any of the above-mentioned states, the CPU 32 recognizes that the torque variation determination condition is satisfied and executes step 105. It will be noted that the engine is in the decelerating state when the intercycle torque variation amounts DTRQ have positive values continuously, for example, five consecutive times. The torque-variation based control procedure is stopped in the decelerating state because a decrease in the torque arising from a decrease in amount of intake air cannot be distinguished from a decrease in torque arising from a degradation in combustion.

At step 105, the CPU 32 calculates the accumulated value of intercycle torque variation amounts, $DTRQ10_i$ as follows:

$$DTRQ10_i = DTRQ10_{i-1} + DTRQ \quad (4)$$

The intercycle torque variation amount accumulating value $DTRQ10_i$ is the sum of the accumulated value $DTRQ10_{i-1}$ of the intercycle torque variation amounts up to the previous time and the intercycle torque variation amount DTRQ calculated at the present time.

At step 106, the CPU 32 determines whether or not the number of cycles CYCLE10 has become equal to a predetermined value (for example, 10). When it is determined, at step 106, that the number of cycles CYCLE10 is smaller than the predetermined value, the CPU 32 increases the number of cycles CYCLE10 by 1 at step 110, and ends the main routine shown in FIG. 5A at step 112.

The accummulating value of intercycle torque variation amount, obtained by repeatedly executing the above-mentioned main routine a predetermined number of times (for example, 10 times) can be considered an approximately accurate torque variation amount. After the result of the determination executed at step 106 becomes YES, the CPU 32 executes step 107, at which step a torque variation amount TH is calculated as per the equation below:

$$TH = (1/16)(DTRQ10_i - TH_{i-1}) + TH_{i-1} \quad (5)$$

It can be seen from equation (5) that the torque variation amount TH is a weighted average obtained by multiplying, by 1/16, the value obtained by subtracting the present intercycle torque variation amount accumulating value $DETQ10_i$ from the previous torque variation amount $TH_{i-1}$ and adding the resulting value to the previous torque variation amount $TH_{i-1}$. It will be noted that the measurement unit 11 shown in FIG. 2 carries out (or is composed of) the steps 101–107 and 201.

When it is determined, at step 103, that the engine operating condition has changed, or when it is determined, at step 104, that the torque variation decision condition is not satisfied, the CPU 32 executes step 111. At step 111, the CPU 32 resets to zero the intercycle torque variation accumulating value DTRQ10, and resets to zero an allowable torque variation range counter $C_{FUKAN}$ (which will be described in detail later). Then, the CPU 32 resets the number of cycles CYCLE10 to zero.

FIG. 8-(C) shows a change in the number of cycles CYCLE10. The number of cycles CYCLE10 is reset to zero at step 109 when it has become equal to the predetermined value used in step 106 (which corresponds to a value indicated by III in FIG. 8-(C) and is equal to, for example, 10). FIG. 8-(D) shows the accumulating procedure on the intercycle torque variation amounts DTRQ. The value obtained by accumulating 10 intercycle torque variation amounts DTRQ is the intercycle torque variation amount accumulating value DTRQ10. The torque variation amount TH obtained by equation (5) changes, as shown in (A) of FIG. 9.

A description will now be given, with respect to FIG. 6, of the allowable torque variation range correcting procedure executed at step 108 shown in FIG. 5A. At step 301, the CPU 32 determines whether or not the torque variation decision value KTH is greater than the torque variation amount TH. The torque variation decision value KTH is calculated by using the two-dimensional map of the engine revolution number NE and the amount of intake air QN. The engine revolution number NE can be obtained from the output signal of the crank angle sensor 30. The above map is stored in the memory 33. The allowable torque variation range has an upper limit corresponding to the torque variation decision value KTH and a lower limit corresponding to TKH$-\alpha$. That is, the allowable torque variation range has a magnitude $\alpha$.

When it is determined, at step 301, that TH$\geqq$KTH, the torque variation amount TH has a value which exceeds the upper limit of the allowable torque variation range. At this time, the air-fuel mixture is excessively lean. Thus, the CPU 32 resets the counter $C_{FUKAN}$ to zero at step 302, and executes a rich-oriented correction procedure at step 303. Thereby, the intercycle torque variation amount DTRQ decreases. In the rich-oriented correction procedure, a learning value (correction value) $KGCP_i$ is increased as per the equation below:

$$KGCP_i = KGCP_{i-1} + 0.4\% \quad (6)$$

When it is determined, at step 301, that TH<KTH, the CPU 32 determines that the value of the counter $C_{FUKAN}$ is smaller than a decision constant $\beta$ ($\beta$ is a natural number equal to or greater than 2) at step 304. The counter $C_{FUKAN}$ is smaller than $\beta$ when step 304 is executed for the first time. At this time, the CPU 32 executes step 305, at which step the torque variation amount TH is compared with the lower limit (KTH$-\alpha$) of the allowable torque variation range.

When it is determined, at step 305, that TH$\geqq$KTH$-\alpha$, the torque variation amount TH is within the allowable torque variation range. Hence, the CPU 32 increases the counter $C_{FUKAN}$ by 1 at step 306, and ends the routine shown in FIG. 6 at step 310.

When it is determined, at step 305, that TH<KTH$-\alpha$, the torque variation amount TH is smaller than the lower limit (KTH$-\alpha$) of the allowable torque variation range. At this time, the air-fuel mixture is rich. Hence, the CPU 32 sets the counter value in the counter $C_{FUKAN}$ to $\beta$ at step 308, and executes a lean-oriented correction procedure at step 309. In the lean-oriented correction procedure, the learning value $KGCP_i$ is decreased as in the equation below:

$$KGCP_i = KGCP_{i-1} - 0.2\% \quad (7)$$

The correction value "0.2%" in equation (7) is smaller than the correction value "0.4%" in equation (6). This is based on reasons as follows. During the rich-oriented correction procedure, the mixture is excessively lean and the combustion is unstable, so that the engine is liable to misfire. In order to prevent the engine from misfiring, it is necessary to rapidly control the torque variation amount to be TH within the allowable torque variation range. During the lean-oriented correction procedure, the combustion is stable, and it is thus sufficient to gradually change the torque variation amount TH toward the allowable torque variation range.

Figures 10, 11:
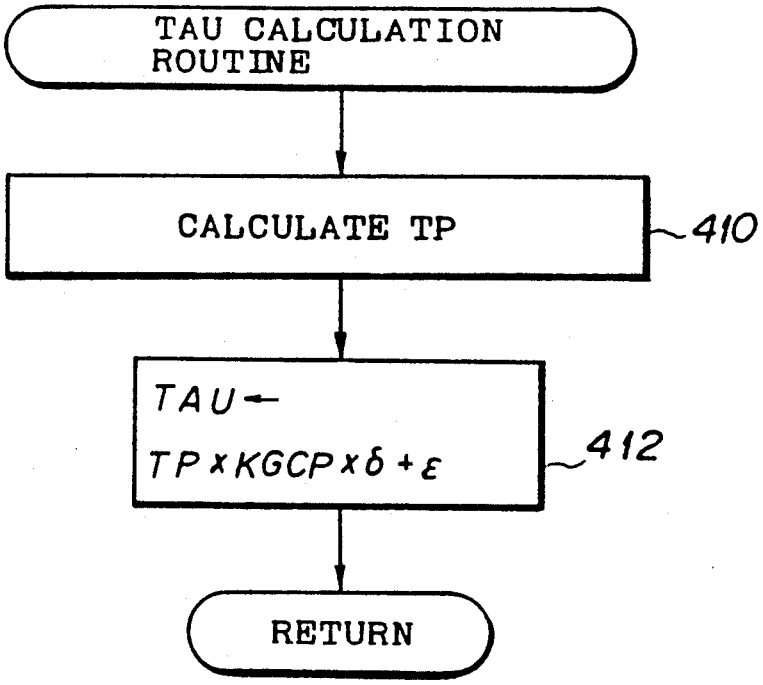
FIG. 10 is a diagram of a two-dimensional map.
FIG. 11 is a flowchart of an injection fuel amount calculation routine.

The learning values $KGCP_i$ obtained at steps 303 and 309 are stored in one of the learning areas K00–K34 of a two-dimensional map shown in FIG. 10 which learning areas are addressed by the engine revolution number NE and a weighted average amount of intake air QNSM. Target torque variation amounts KTH other than those defined in the table can be obtained by interpolation.

Figure 6:
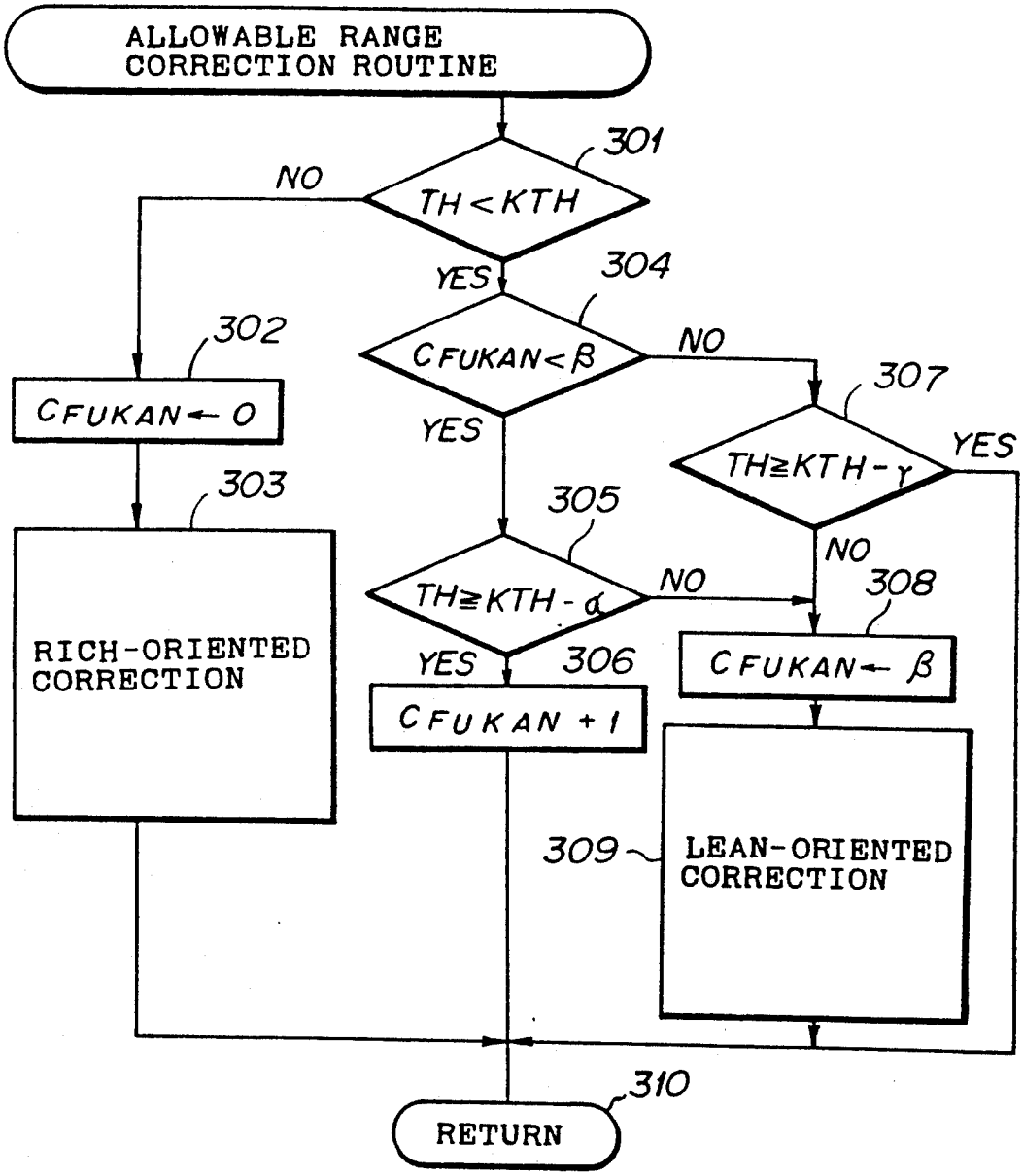
FIG. 6 is a flowchart of an allowable torque variation range correcting procedure according to the first preferred embodiment of the present invention.

When the torque variation amount TH is continuously within the allowable torque variation range during the time the routine shown in FIG. 6 is repeatedly activated $\beta$ times, steps 301, 304–306 and 310 are carried out $\beta$ times, so that the counter value in the counter $C_{FUKAN}$ becomes equal to $\beta$. Thus, the routine shown in FIG. 6 is activated, and step 307 is executed via step 304. At step 307, the CPU 32 determines whether or not the torque variation amount TH is greater than or equal to a threshold value (KTH$-\gamma$) where $\gamma$ is a constant smaller than $\gamma$. The threshold value (KTH$-\gamma$) corresponds to the lower limit of the allowable torque variation range. That is, the allowable torque variation range $\gamma$ is smaller than the allowable torque variation range $\alpha$. Hence, the torque variation amount TH is controlled so that it approximates the torque variation decision value (target torque variation amount) KTH.

When it is determined, at step 307, that TH$\geqq$KTH$-\gamma$, the CPU 32 ends the routine shown in FIG. 6. When the result obtained at step 307 is NO, the CPU 32 executes step 308. It will be noted that the detection unit 14 (FIG. 2) corresponds to the combination of the steps 301 and 304–306 and the range changing unit 15 (FIG. 2) corresponds to step 307. Further, the control unit 13 corresponds to the combination of the steps 303 and 309, and the setting unit 12 corresponds to step 301.

Figure 9:
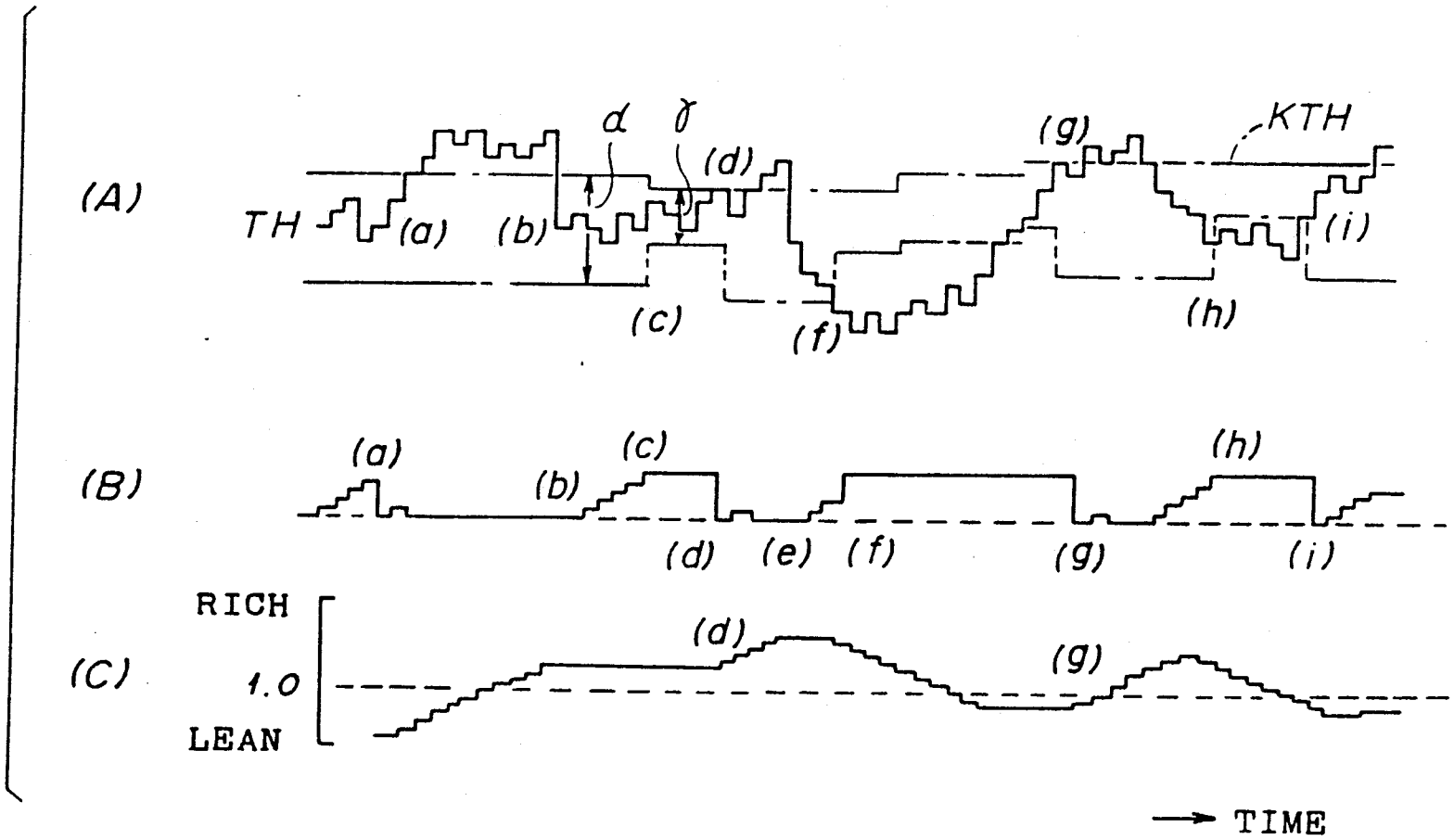
FIG. 9 is a waveform diagram showing a torque variation amount, a counter and a learning value used in the first preferred embodiment of the present invention.

Referring to FIG. 9-(A) and (B) which shows a change in the torque variation amount TH, it is now assumed that the engine operating condition changes at times (a), (b), (e) and (i). A change in the engine operating condition is detected by step 103 shown in FIG. 5A. Each time a change in the engine operating condition is detected, the learning area number of the map shown in FIG. 10 changes, and resultingly the torque variation decision value KTH obtained from the map by an interpolation procedure changes, as shown in (A) of FIG. 9 (KTH may not change even if the engine operating condition changes due to the interpolation procedure).

As shown in (A) of FIG. 9, when the torque variation value TH becomes equal to or greater than the torque variation decision value KTH immediately after (a), or at times (d) and (g), the counter value in the counter $C_{FUKAN}$ is reset to zero (at step 302), as shown in (B) of FIG. 9. Further, as shown in (C) of FIG. 9, the learning value $KGCP_i$ starts to gradually increase by means of the rich-oriented correction procedure based on formula (6).

At times (c) and (h), the torque variation amount TH is continuously within the allowable torque variation range for the predetermined period. Thus, the allowable torque variation range is narrowed (changed from $\alpha$ to $\gamma$) at each of times (c) and (h). The torque variation amount TH is continuously within the narrowed allowable torque variation range immediately after time (c) ($TH \geqq KTH-\gamma$). Thus, the procedure shown in FIG. 6 ends. Immediately after time (h), $TH<KTH-\gamma$, and thus the CPU 32 executes steps 308 and 309 after executing step 307.

At time (f) in (A) of FIG. 9, TH becomes smaller than $TKH-\alpha$. At this time, the counter value in the counter $C_{FUKAN}$ is reset to zero by the steps 301, 302 and 303. Further, the learning value $KGCP_i$ is gradually increased by the lean-oriented correction procedure based on the equation (7). It will be noted that in FIG. 9, for the sake of simplicity, the correction value used for the lean-oriented correction procedure is equal to that used for the rich-oriented correction procedure.

A description will now be given of an air-fuel ratio control procedure based on the learning value $KGCP_i$ with reference to FIG. 11. FIG. 11 shows a fuel injection time (TAU) calculation routine, activated at every predetermined crank angle (for example, at every 360°). At step 401, the CPU 32 reads data about the amount of intake air QNSM and the engine revolution number NE from the map stored in the memory 33, and calculates a basic fuel injection time TP therefrom. At step 402, the CPU 32 calculates the fuel injection time TAU as follows:

$$TAU-TP\times KGCP\times\delta+\epsilon \quad (8)$$

where $\delta$ and $\epsilon$ are correction values based on other engine operating parameters, such as the throttle opening angle and a warm-up fuel increase coefficient. The aforementioned fuel injection values $25_1$-$25_4$ inject fuel during the fuel injection time TAU. After step 303 is executed, the learning value KGCP in equation (8) becomes greater than the previous learning value. Thus, the fuel injection time TAU is lengthened and the air-fuel ratio is controlled so that the mixture becomes rich. On the other hand, after step 309 is executed, the fuel injection time TAU is shortened and the air-fuel ratio is controlled so that the mixture becomes lean.

In the above-mentioned manner according to the first preferred embodiment of the present invention, the allowable torque variation range is changed from $\beta$ to $\gamma(\alpha>\gamma)$ when the torque variation amount TH is continuously within the allowable torque variation range $\gamma$ during the predetermined period (which corresponds to 720° $CA\times\beta$). Then, the torque variation amount TH is controlled so that it falls within the narrowed allowable torque variation range having the width $\gamma$. Thus, it becomes possible to maintain the torque variation amount at a level equal to or close to the target torque variation amount (torque variation decision value) KTH. As a result, it becomes possible to improve fuel economy and the quality of emission.

Figure 2B:
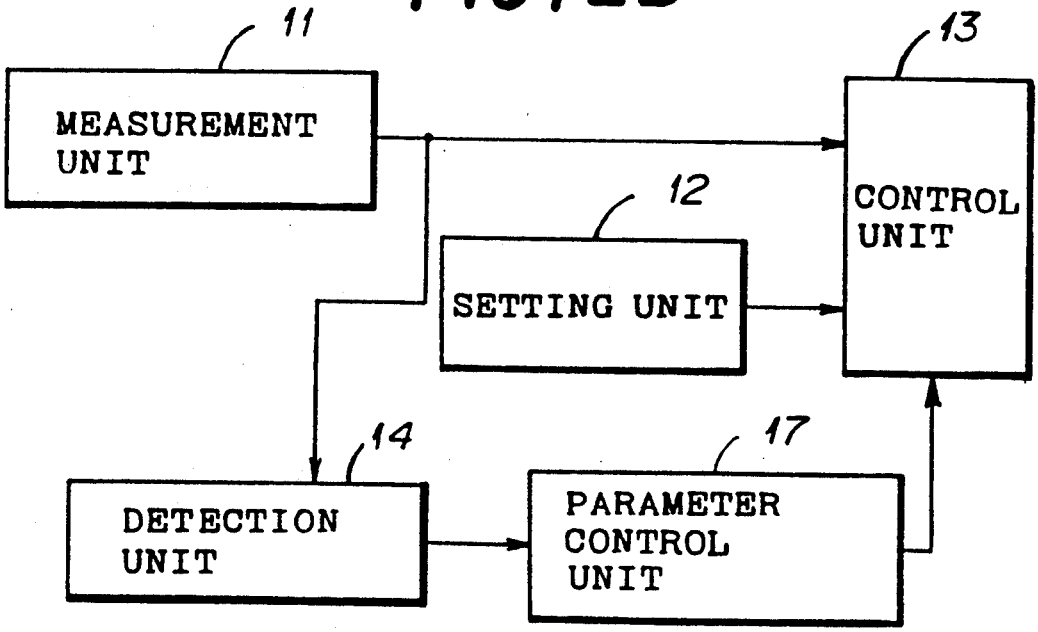
FIG. 2B is a block diagram of a torque variation control apparatus according to a second preferred embodiment of the present invention.

A description will now be given of a second preferred embodiment of the present invention with reference to FIG. 2B, in which those parts which are the same as those shown in the previously described figures are given the same reference numerals. A parameter control unit 17 shown in FIG. 2B is substituted for the range changing unit 15 shown in FIG. 2A. The parameter control unit 17 controls a predetermined engine control parameter on the basis of the detection output signal from the detection unit 14 so that the intercycle torque variation amount is intentionally increased. More specifically, when the torque variation amount is continuously within the allowable torque variation range for a predetermined period, the parameter control unit 17 controls the predetermined parameter so that the torque variation amount increases.

Figure 12:
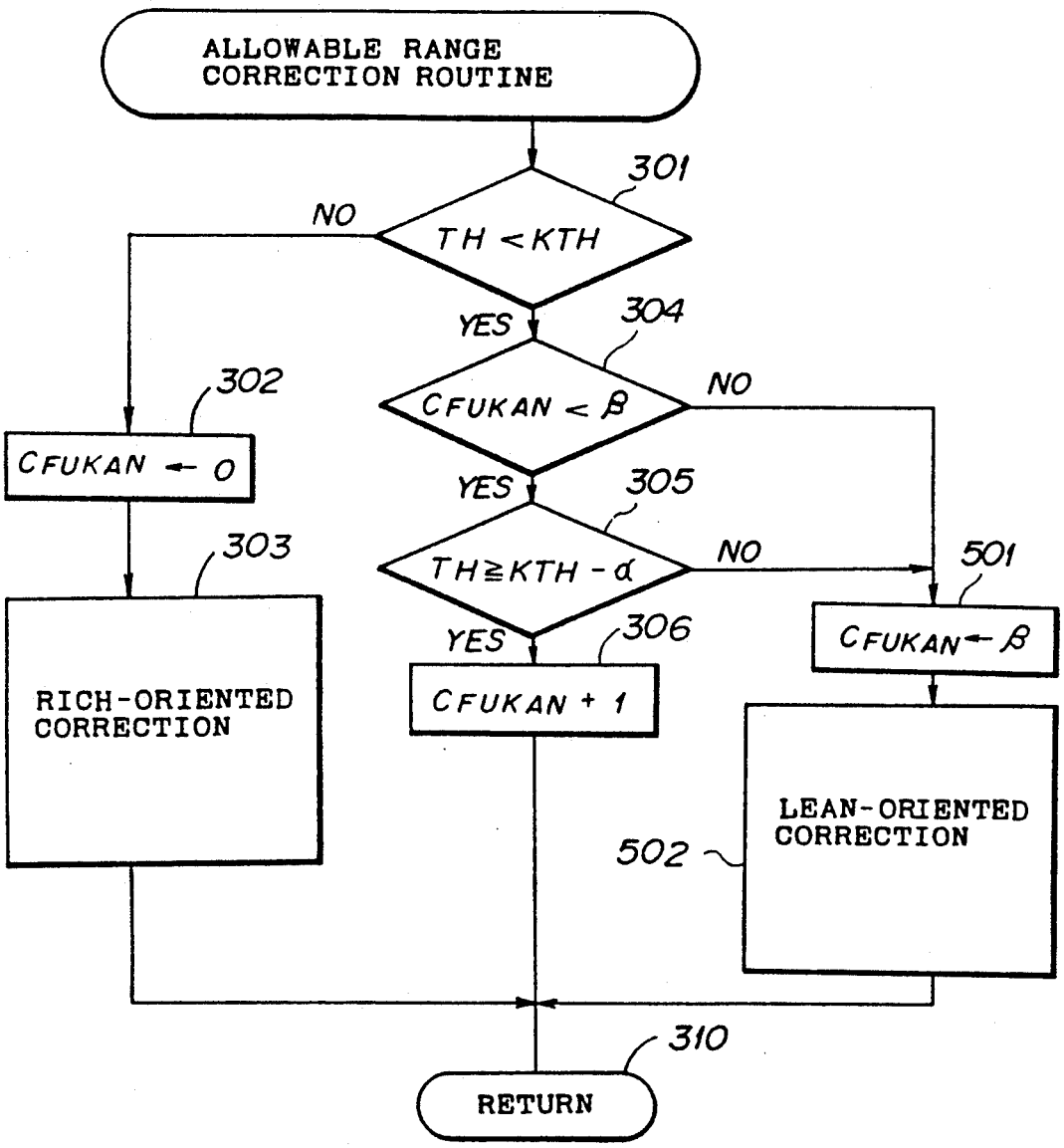
FIG. 12 is a flowchart of an allowable torque variation range correcting procedure according to the second preferred embodiment of the present invention.

The operation of the second preferred embodiment of the present invention will be described with reference to FIG. 12, which shows an allowable variation range correcting routine. In FIG. 12, those parts which are the same as those shown in FIG. 6 are given the same reference numerals. The routine shown in FIG. 12 does not have step 307 shown in FIG. 6. Steps 501 and 502 shown in FIG. 12 correspond, respectively, to steps 308 and 309 shown in FIG. 6. When the torque variation amount TH is continuously within the allowable torque variation range during the predetermined period (step 304) or when the torque variation amount TH is smaller than the lower limit of the allowable torque variation range (step 305), steps 501 and 502 are successively executed by the CPU 32.

When it is determined, at step 304, that $C_{FUKAN}\geqq\beta$, or it is determined, at step 305, that $TH<KTH-\alpha$, the allowable torque variation range is omitted, and the air-fuel ratio is feedback-controlled so that the torque variation amount TH increases intentionally. In the above-mentioned manner, it is also possible to improve the fuel economy and the quality of emissions.

Figure 13:
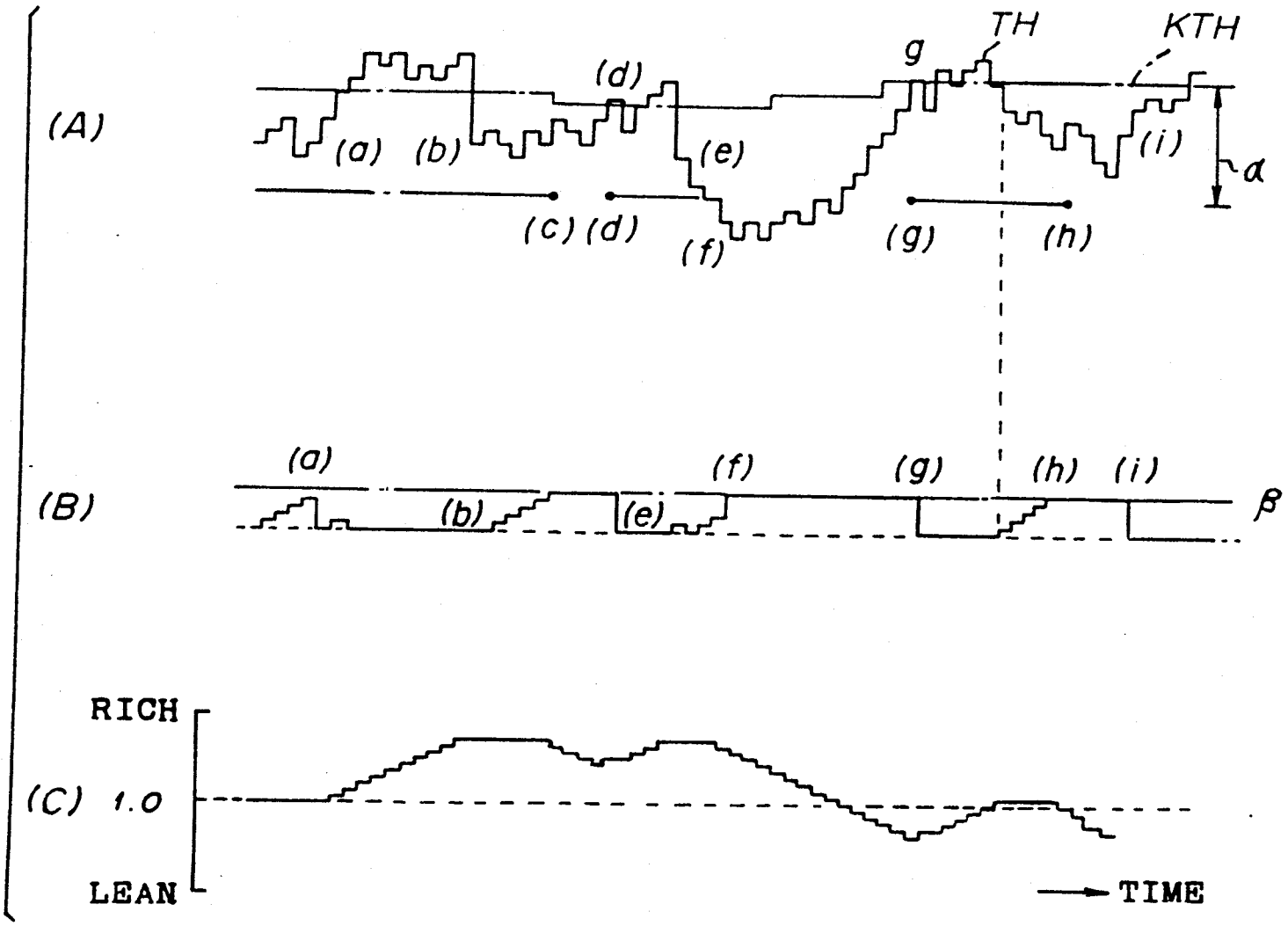
FIG. 13 is a waveform diagram showing the operation of the second preferred embodiment of the present invention.

FIG. 13 is a waveform diagram showing operation of the second embodiment of the present invention. In FIG. 13, parts which are the same as those shown in FIG. 9 are given the same reference symbols. FIG. 12-(A) shows the torque variation amount TH, FIG. 12-(B) shows the counter value in the counter $C_{FUKAN}$, and FIG. 12-(C) shows the learning value KGCP. The allowable torque variation range is omitted at times (c), (f), (g) and (h).

When $TH<KTH-\alpha$ before the counter value in the counter $C_{FUKAN}$ reaches $\beta$, the counter value in the counter $C_{FUKAN}$ is reset to $\beta$ (at step 305). Hence, steps 301, 304, 501, 502 and 310 are repeatedly carried out in this sequence until the torque variation amount TH becomes equal to or greater than the target torque variation amount KTH. For example, the routine shown in FIG. 12 is activated at time (f) and the above-mentioned steps are repeatedly carried out until time (g). The torque variation amount TH is greater than the target torque variation amount KTH immediately after time (g). That is, the torque variation amount TH is increased to be greater than the target torque variation amount KTH, and then decreased, so that the actual torque variation amount TH becomes close to the target torque variation amount KTH.

In each of the first and second embodiments of the present invention, it is also possible to control the amount of recirculated exhaust gas instead of the air-fuel ratio. For example, at step 303, the amount of recirculated exhaust gas may be decreased. At step 309, the amount of recirculated exhaust gas may be increased.

The present invention is not limited to the specifically disclosed embodiments, and variations and modifications may be made without departing from the scope of the present invention.

What is claimed is:

1. An apparatus for controlling a torque generated by an internal combustion engine, said apparatus comprising:

means for measuring a torque variation amount of the internal combustion engine;

means for detecting whether or not the measured torque variation amount exists in a predetermined allowable torque variation range; and means, coupled to said means for measuring and said means for detecting, for controlling a predetermined engine control parameter of said internal combustion engine so that the torque variation amount can be adjusted to exist in said predetermined allowable torque variation range;

wherein said means for detecting further detects a stable state when the measured torque variation amount is continuously maintained in the allowable torque variation range during a predetermined period of time; and said means for controlling further controls said predetermined engine control parameter to increase the torque variation amount toward a predetermined maximum value when said means for detecting detects said stable state.

2. The apparatus of claim 1, wherein:

the allowable torque variation range has an upper limit which corresponds to target torque variation amount, and a lower limit; and said means for controlling the predetermined engine control parameter so that the torque variation amount is always maintained around the upper limit of the allowable torque variation range.

3. The apparatus of claim 1, wherein said means for controlling comprises means for increasing the torque variation amount so that the torque variation amount becomes greater than an upper limit of the allowable torque variation range when said detection means detects the stable state.

4. The apparatus of claim 1, wherein:

said predetermined engine control parameter is an air-fuel ratio; and said means for controlling comprises means for controlling the air-fuel ratio so that a mixture of air and fuel becomes lean when said detection means detects the stable state.

5. The apparatus of claim 1, wherein:

said predetermined engine control parameter is an amount of recirculated exhaust gas which is fed back to an air intake system of the internal combustion engine from an exhaust system thereof; and said means for controlling comprises means for controlling the amount of recirculated exhaust gas so that the amount of recirculated exhaust gas increases when said detection means detects the stable state.

6. The apparatus of claim 1, wherein said means for controlling comprises means for controlling the predetermined engine control parameter so that the torque variation amount decreases when the torque variation amount is greater than an upper limit of said allowable torque variation range.

7. The apparatus of claim 1, wherein said means for controlling comprises means for controlling the predetermined engine control parameter so that the torque variation amount increases when the torque variation amount is smaller than a lower limit of said allowable torque variation range.

8. The apparatus of claim 1, wherein:

said means for measuring comprises means for generating an intercycle torque variation amount showing a torque difference between consecutive cycles of the internal combustion engine and means for generating a weighted average of a predetermined number of intercycle torque variations amounts; and said weighted average corresponding to said torque variation amount.

9. The apparatus of claim 8, wherein said intercycle torque variation amount shows a decrease in the torque generated by the internal combustion engine.

10. The apparatus of claim 1, wherein said apparatus further comprises:

a memory storing a plurality of allowable torque variation ranges based on a plurality of engine operating conditions; and means, coupled to said memory, said means for detecting and said, for controlling a predetermined engine control parameter for selecting, on the basis of a current engine operating condition, one of the plurality of allowable torque variation ranges stored in said memory, said one of the plurality of allowable torque variation ranges being input to said means for detecting and said means for controlling a predetermined engine control parameter.

11. The apparatus of claim 10, wherein said engine operating conditions comprises an engine revolution number and an amount of air introduced in the internal combustion engine.

12. The apparatus of claim 1, wherein said means for controlling comprises means for upwardly changing a; lower limit of the allowable torque variation range thereby narrowing the allowable torque variation range.

13. The apparatus of claim 12, wherein the allowable torque variation range has a fixed upper limit.

14. The apparatus of claim 13, wherein the fixed upper limit of the allowable torque variation range corresponds to a target torque variation amount.

15. A method for controlling a torque generated by an internal combustion engine comprising the steps of:

a) measuring a torque variation amount of the internal combustion engine;

b) detecting whether or not the measured torque variation amount falls within a predetermined allowable torque variation range;

c) adjusting a predetermined engine control parameter related to the torque of the engine until the measured torque variation amount falls within said predetermined allowable torque variation range, if the measured torque variation amount if outside of said predetermined allowable torque variation range;

d) detecting whether a stable state exists, a stable state occurring when the measured torque variation amount remains within said predetermined allowable torque variation range for a predetermined period of time, if the measured torque variation amount falls within said predetermined allowable torque variation range;

1) repeating the adjusting operation of step c) if a stable state does not exist, 2) readjusting said predetermined engine control so that the measured torque variation approaches an upper limit of said predetermined allowable torque variation range, if a stable state exists.

16. The method of claim 15 wherein said step of measuring comprises the substeps of:

generating an intercycle torque variation amount showing a torque difference between consecutive cycles of the internal combustion engine; and generating a weighted average of a predetermined number of intercycle torque variation amounts, said weighted average corresponding to said torque variation amount.

17. The method of claim 15 wherein said predetermined engine control parameter is an air-fuel ratio and said step of readjusting further comprising the substep of controlling the air-to fuel ratio so that a mixture of air and fuel becomes more lean if a stable state exists.

18. The method of claim 15 wherein said predetermined engine control parameter is an amount of recirculated exhaust gas which is fed back to an air intake system of the internal combustion engine from an exhaust system thereof and wherein said step of readjusting comprises the substep of controlling the amount of recirculated exhaust gas so that the amount of recirculated exhaust gas increases when said stable state exists.

19. The method of claim 15 wherein said step of readjusting comprises the substep of selecting a new allowable torque variation range from among a plurality of such ranges stored in a memory, and repeating steps a) to d) using said new allowable torque variation range in place of said predetermined allowable torque variation.

20. The method of claim 19 wherein said step of measuring comprises the substeps of:

generating an intercycle torque variation amount showing a torque difference between consecutive cycles of the internal combustion engine; and generating a weighted average of a predetermined number of intercycle torque variation amounts, aid weighted average corresponding to said torque variation amount.

21. The method of claim 15, wherein said step of readjusting said predetermined engine control comprises the substep of adjusting a value of a lower limit of said predetermined allowable torque variation range toward an upper limit of the range, thereby narrowing the allowable torque variation range to a new predetermined range.

22. The method of claim 21, wherein said step of readjusting said engine control parameter further comprises after adjusting the value of the lower limit of said predetermined allowable torque variation range to provide a new predetermined range, repeating steps a) to d) using the new predetermined range in place of said predetermined allowable range.

23. The method of claim 21 wherein said step of measuring comprises the substeps of:

generating an intercycle torque variation amount showing a torque difference between consecutive cycles of the internal combustion engine; and generating a weighted average of a predetermined number of intercycle torque variation amounts, and weighted average corresponding to said torque variation amount.

* * * * *

UNITED STATES PATENT AND TRADEMARK OFFICE

CERTIFICATE OF CORRECTION

PATENT NO. : 5,226,390

DATED : July 13, 1993

INVENTOR(S) : Norihisa Nakagawa

It is certified that error appears in the above-identified patent and that said Letters Patent is hereby corrected as shown below:

| Column | Line | |
|---|---|---|
| 1 | 31 | After "gas" change "s" to --is--. |
| 5 | 13 | Change "positions. A" to --positions, a--. |
| 5 | 52 | Change "a" to --as--. |
| 9 | 28 | Change "TAU—TP..." to --TAU←TP...--. |
| 9 | 44 | Change "β" to -- α --. |
| 12 | 1 | Change "variations" to --variation--. |
| 12 | 14 | After "said" delete "," and insert --means--. |
| 12 | 15 | After "parameter" insert --,--. |
| 12 | 27 | After "a" delete --;--. |

UNITED STATES PATENT AND TRADEMARK OFFICE

CERTIFICATE OF CORRECTION

PATENT NO. : 5,226,390

DATED : July 13, 1993

INVENTOR(S) : Norihisa Nakagawa

It is certified that error appears in the above-identified patent and that said Letters Patent is hereby corrected as shown below:

| Column | Line | |
|---|---|---|
| 12 | 48 | Change "if" to --is--. |
| 13 | 23 | After "variation" insert --range--. |
| 14 | 2 | Change "aid" to --said--. |
| 14 | 25 | Change "and" to --said--. |

Signed and Sealed this

Twenty-sixth Day of April, 1994

Bruce Lehman

*Attest:*

BRUCE LEHMAN

*Attesting Officer*

*Commissioner of Patents and Trademarks*